US011852312B2

(12) United States Patent
Jars et al.

(10) Patent No.: US 11,852,312 B2
(45) Date of Patent: Dec. 26, 2023

(54) OPTICAL COMPONENT INTENDED TO OPERATE WITH TOTAL INTERNAL REFLECTION

(71) Applicant: VALEO VISION, Bobigny (FR)

(72) Inventors: Blaise Jars, Bobigny (FR); Vincent Huet, Bobigny (FR)

(73) Assignee: Valeo Vision, Bobigny (FR)

( * ) Notice: Subject to any disclaimer, the term of this patent is extended or adjusted under 35 U.S.C. 154(b) by 62 days.

(21) Appl. No.: 17/616,208

(22) PCT Filed: Jun. 23, 2020

(86) PCT No.: PCT/EP2020/067536

§ 371 (c)(1),
(2) Date: Dec. 3, 2021

(87) PCT Pub. No.: WO2020/260303

PCT Pub. Date: Dec. 30, 2020

(65) Prior Publication Data

US 2022/0243890 A1 Aug. 4, 2022

(30) Foreign Application Priority Data

Jun. 28, 2019 (FR) ..... 1907121

(51) Int. Cl.
*F21S 41/32* (2018.01)
*F21S 41/24* (2018.01)

(52) U.S. Cl.
CPC ..... *F21S 41/322* (2018.01); *F21S 41/24* (2018.01)

(58) Field of Classification Search
CPC .. F21S 41/24; F21S 41/27; F21S 41/26; F21S 41/265; F21S 41/25; F21S 41/255; F21S 41/322; F21S 41/365; F21V 2200/00; F21V 5/04; F21V 7/0091
See application file for complete search history.

(56) References Cited

U.S. PATENT DOCUMENTS

| | | | | |
|---|---|---|---|---|
| 10,690,309 | B2 | 6/2020 | Gromfeld | |
| 2006/0087860 | A1 | 4/2006 | Ishida | |
| 2006/0239020 | A1 | 10/2006 | Albou | |
| 2017/0211771 | A1 | 7/2017 | Nishimura et al. | |
| 2019/0086050 | A1 * | 3/2019 | Dikau ..... | F21S 41/322 |

FOREIGN PATENT DOCUMENTS

| | | | | |
|---|---|---|---|---|
| EP | 2865937 | A1 * | 4/2015 | ..... F21S 41/147 |
| EP | 3290777 | A1 | 3/2018 | |
| EP | 3299703 | A1 | 3/2018 | |

OTHER PUBLICATIONS

Search English translation of EP 2865937 A1 (Year: 2015).*
European Patent Office, International Search Report and Written Opinion of corresponding International Application No. PCT/EP2020/067536, dated Sep. 2, 2020 (including English translations).

* cited by examiner

*Primary Examiner* — Omar Rojas Cadima
(74) *Attorney, Agent, or Firm* — Valeo Vision

(57) ABSTRACT

A light shielding component including a covering portion, and a snap-fit portion, with the covering portion used to cover a light guide to block the transmission of light rays. The snap-fit portion including at least one slot, which is used to fix the light shielding component.

11 Claims, 6 Drawing Sheets

[Fig. 1]
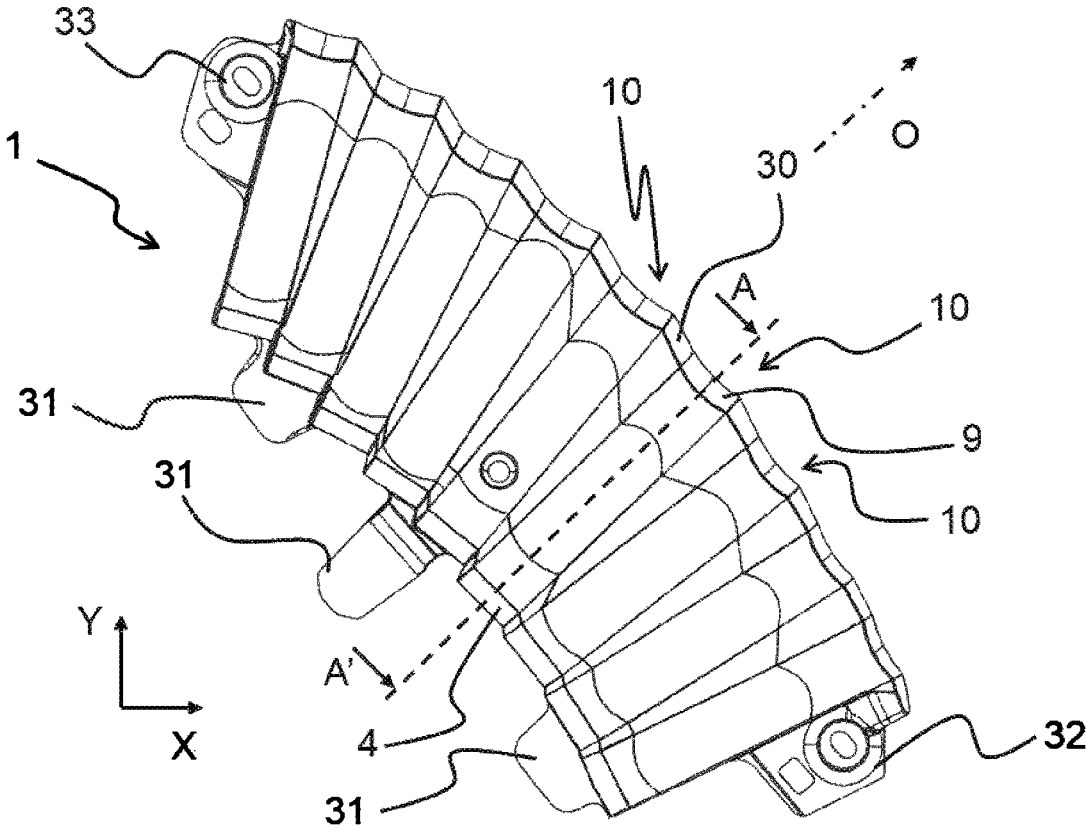
[Fig. 2]
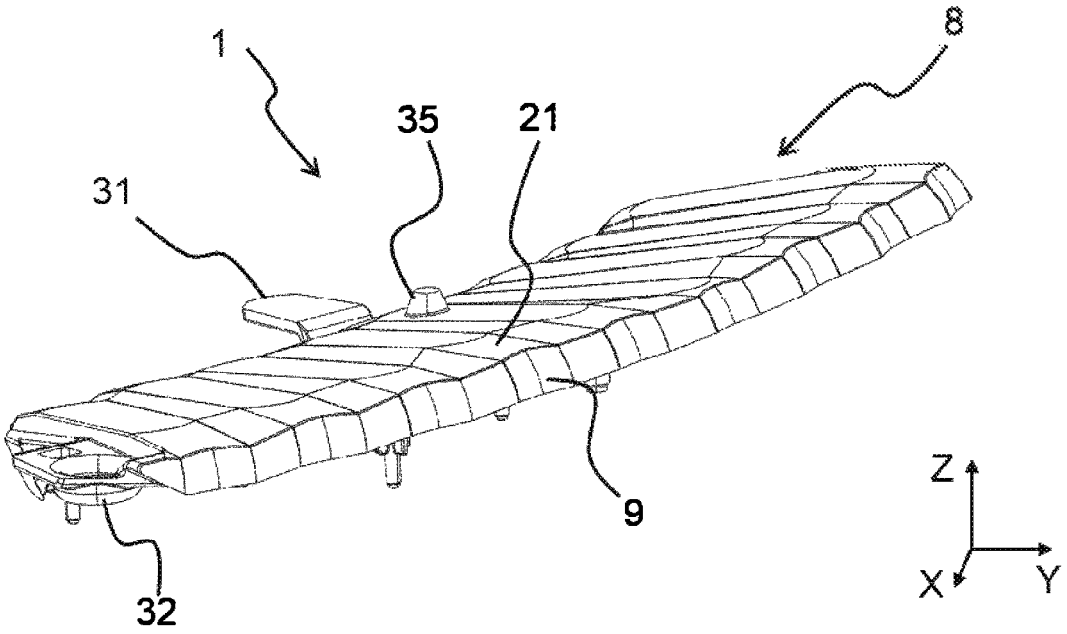

[Fig. 3]
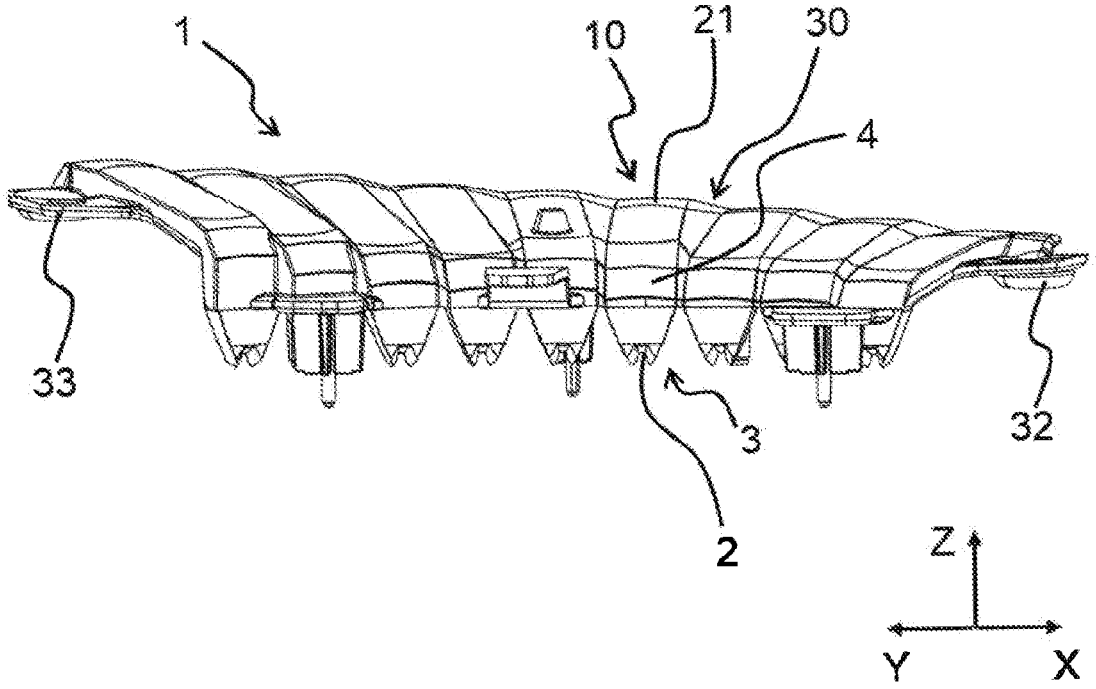

[Fig. 4]
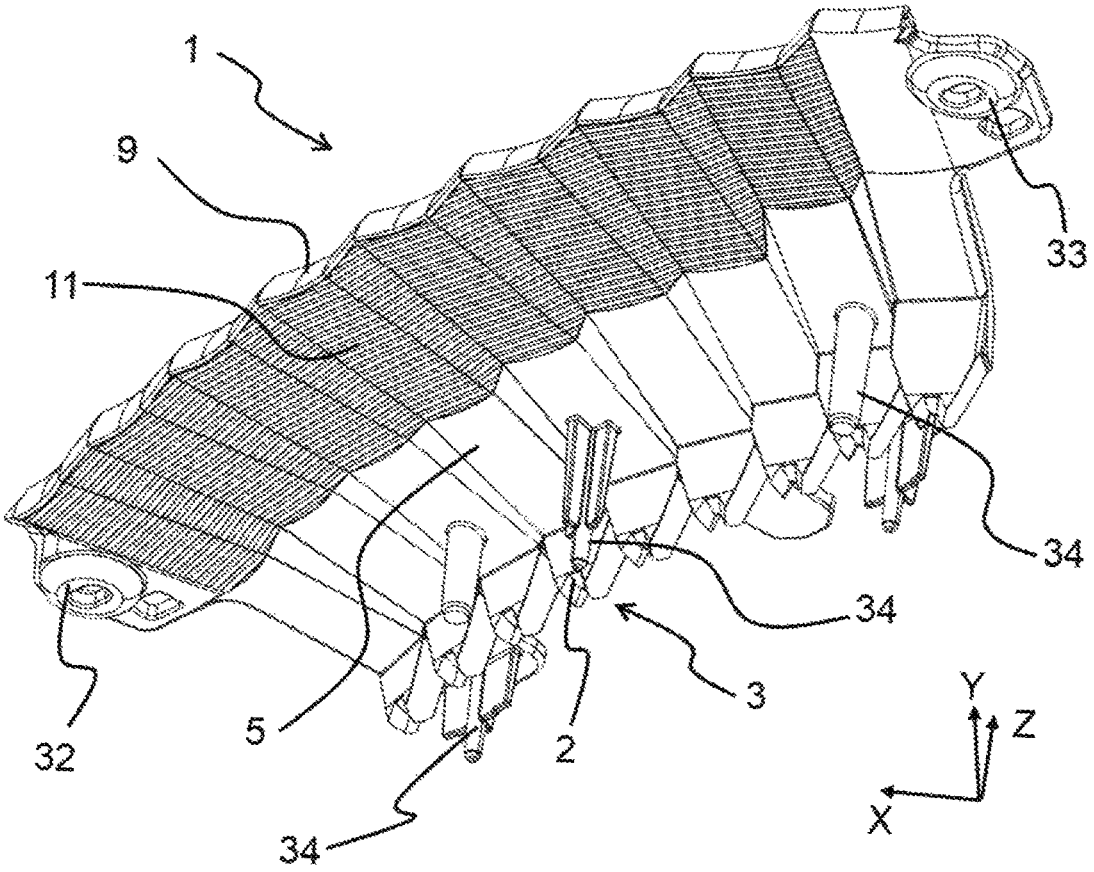

[Fig. 5]
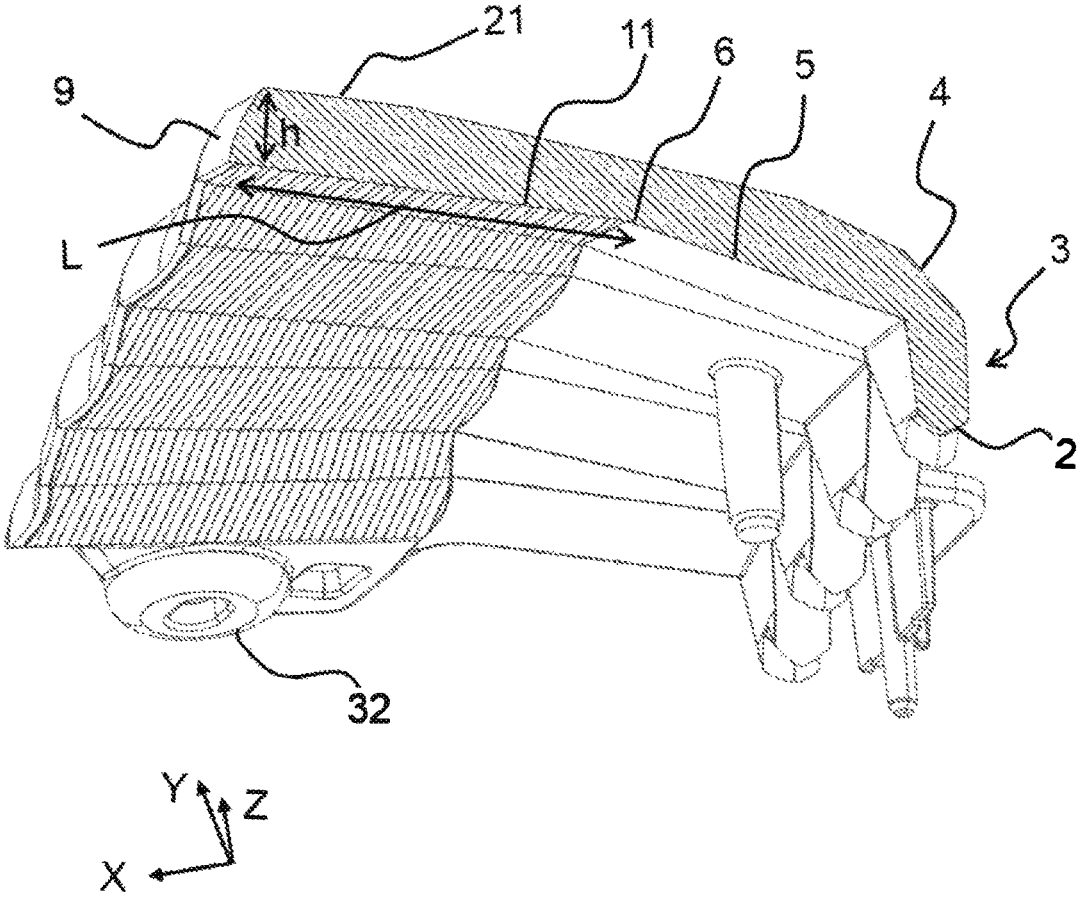

[Fig. 6]
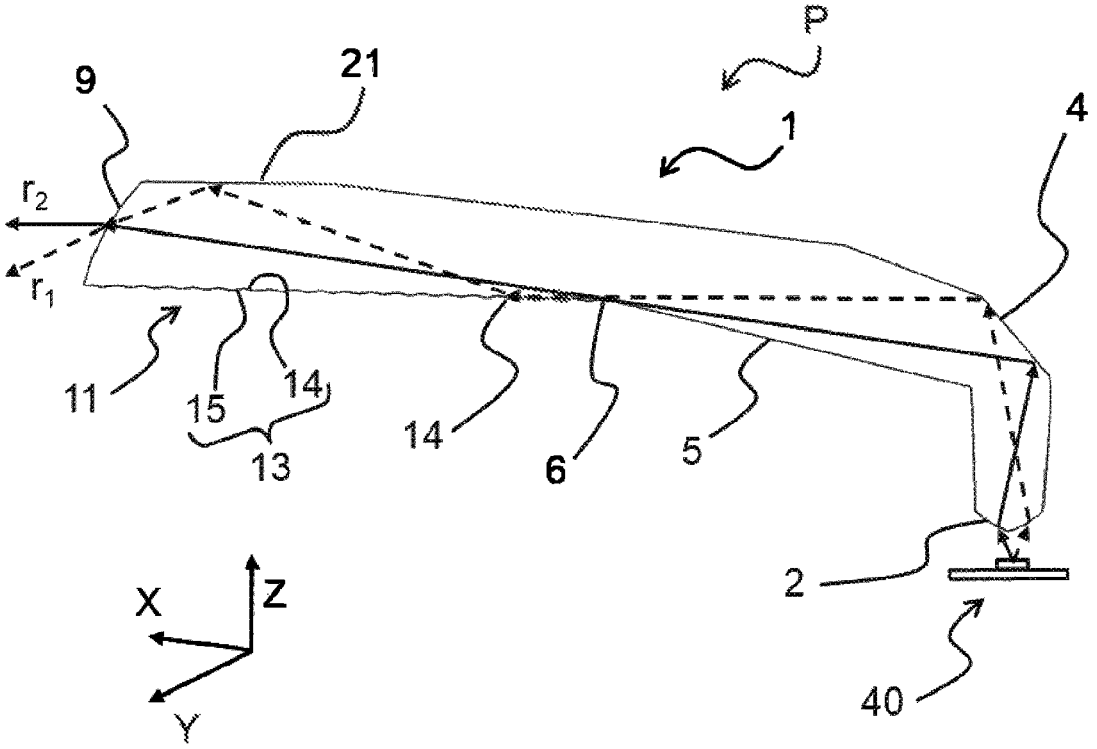
[Fig. 7]
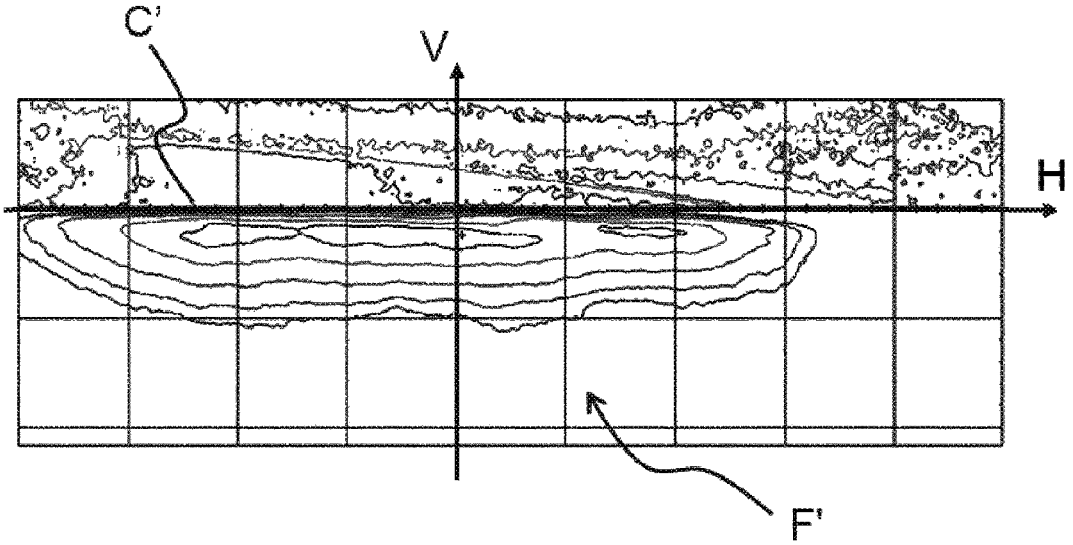

[Fig. 8]
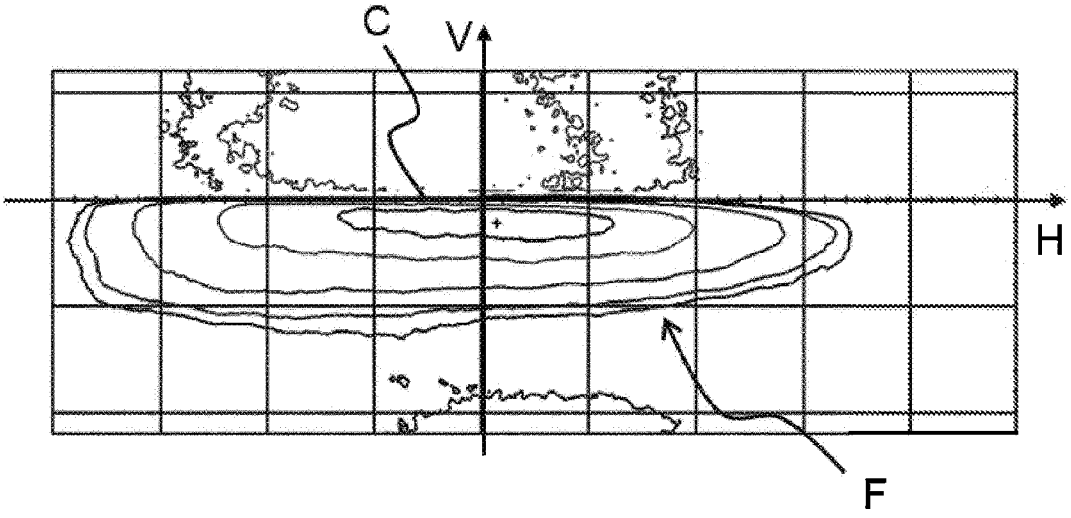

OPTICAL COMPONENT INTENDED TO OPERATE WITH TOTAL INTERNAL REFLECTION

CROSS-REFERENCE TO RELATED APPLICATIONS

This is a 371 application (submitted under 35 U.S.C. § 371) of International Application No. PCT/EP2020/067536 (WO2020/260303) filed on Jun. 23, 2020, which claims priority date benefit to French Application No. 1907121 filed Jun. 28, 2019, the disclosures of which are incorporated herein by reference in their entirety.

TECHNICAL FIELD

The present invention relates to the field of motor vehicle lighting devices. The present invention relates more particularly to an optical component arranged so as to operate with total internal reflection and designed so as to form a beam with a cutoff.

BACKGROUND

It is known to use light guides in which light is guided from an entry diopter to an exit diopter. Light propagates there through total internal reflection from the reflection surfaces of this guide that are located between the entry and exit diopters. Giving these reflection surfaces specific shapes and positions makes it possible to obtain a beam with a given photometry.

In the case of a low beam, or more generally of a beam with a cutoff line delimiting an illuminated area from a dark area containing vehicles being followed or oncoming vehicles, these reflection surfaces are arranged so as to form the beam along with its cutoff line. For example, a reflection surface may form a collector that focuses the rays toward a cutoff edge formed by a ridge separating two other surfaces. An optical system is then arranged so as to image the cutoff edge. This will then form the cutoff line in the beam.

However, it may be the case that parasitic reflections carry some of the rays into the dark area delimited by the cutoff line, thus generating a risk of dazzling. In principle, when designing an optical component, it is sought to reduce these parasitic rays as far as possible.

SUMMARY

In some existing light guides, the surface downstream and below the cutoff edge is arranged vertically, or in other words the cutoff edge is formed by a sharp angle. In this case, no ray that passes next to the cutoff edge impinges on the first reflection surface downstream of the cutoff edge. As a result, due to this angle, the imaging optical system has to extend significantly below the level of the cutoff edge for the imaging system to recover these rays.

The applicant has observed that it was able to reduce this height by decreasing the angle inside the optical component between the surfaces separated by the cutoff edge. However, in doing so, some of the rays that passed next to the cutoff edge impinged on the first reflection surface downstream of the cutoff edge and were returned directly to the imaging optical system. These rays were therefore directed virtually as though they were passing below the row of focal points of the imaging optical system, and were therefore returned above the cutoff, thus increasing the quantity of parasitic rays.

One aim of the present invention is to improve optical components intended to operate with total internal reflection and designed so as to form a beam with a cutoff, in particular while reducing the risk of dazzling, in particular without excessively increasing the height thereof.

To this end, a first subject of the invention relates to an optical component intended to operate with total internal reflection and comprising at least one light guide portion, the guide portion comprising:

- an entry diopter,
- a return surface,
- a cutoff edge,
- a first total internal reflection surface downstream of the cutoff edge,
- a second total internal reflection surface,
- an exit diopter that images a row of focal points, the row of focal points being arranged on the cutoff edge,
- the entry diopter and the return surface being arranged such that the return surface returns the light rays from the entry diopter toward the row of focal points;
- these rays comprise first rays that pass next to the cutoff edge and reach said first reflection surface, the latter being arranged so as to reflect these first rays toward said second reflection surface so as to produce a terminal total internal reflection from this said second reflection surface, these first rays being reflected toward the exit diopter through this terminal total internal reflection.

Thus, by preventing the rays reflected by the first reflection surface from directly reaching the exit diopter, the optical component according to the invention reduces, or even eliminates, the risk of dazzling.

Moreover, it makes it possible to produce components having a cutoff edge with a less pronounced angle, and therefore a lower height compared to the length of the guide portion.

In addition, this also makes it possible to obtain a beam of greater thickness for one and the same guide portion of the same thickness but without this first reflection surface.

This also makes it possible to avoid excessively great brightness concentration above the horizontal.

The lighting device according to the invention may optionally have one or more of the following features:

- the first reflection surface comprises at least one facet arranged so as to reflect said first rays toward said second reflection surface so as to produce said terminal total internal reflection; this simplifies the design of the first reflection surface by managing some of the rays using a facet, since it is the arrangement of the slope thereof that thus makes it possible to return the corresponding rays;
- the first reflection surface comprises one or more prisms, called first prisms, the first prisms each having a reflection slope from which the corresponding rays are reflected, the or each facet being formed by the or one of the reflection slopes; this is a simple way of forming a facet;
- when the first reflection surface has multiple prisms, the reflection slopes are increasingly less steep as they move away from the cutoff edge toward the exit diopter;
- when the first reflection surface has multiple prisms, the pitch between the first prisms is constant; this makes it possible to have a connecting surface between two prisms that is generally of the same height and to avoid variations in thickness that may lead to greater injection stresses in terms of plastics processing;

when the first reflection surface has multiple prisms, the pitch between the first prisms is approximately 1 mm; this small pitch makes it possible to further discretize and to better control the total reflections;

the second reflection surface comprises at least one facet arranged so as to reflect some of these rays reflected by the first reflection surface toward the exit diopter; this or these facets are prisms, called second prisms;

the length of the first reflection surface from the cutoff line to the exit diopter is greater than twice, preferably four times, the height of the exit diopter; by virtue of the arrangement of the first surface, it is possible to obtain such ratios without increasing the risk of dazzling, thus making it possible to have elongated and thin optical components;

the height of the exit diopter is less than or equal to 6 mm;

the optical component comprises a plurality of these said guide portions;

the optical component comprises a plate the downstream segment of which bears the exit diopters of the guide portions, the plate comprising the guide portions arranged directly or indirectly adjacently; there is thus an optical component that is thin with regard to its depth, specifically with regard to the distance between the exit diopters and the corresponding entry diopters;

the guide portions may be arranged indirectly in pairs via an optically inactive joining portion; in other words, the joining portion does not receive any rays traveling in these guide portions.

Another subject of the invention is a vehicle lighting device comprising an optical component according to the invention. This lighting device may in particular be a vehicle headlight.

The vehicle lighting device according to the invention may comprise:

an optical component according to the invention, a light source facing the entry diopter, the lighting device being arranged such that the rays emitted by the light source exit the exit diopter so as to contribute to producing a lighting beam with a cutoff, in particular with a flat cutoff.

In particular, this lighting beam may be a side lighting beam, also called a "cornering" function.

Another subject of the invention is a vehicle comprising a vehicle lighting device according to the invention.

Unless otherwise indicated, the terms "rear", "front", "lower", "upper", "top", "bottom", "right", "horizontal" and their variations in terms of gender or number refer to the direction of light emission from the optical component. Unless otherwise indicated, the terms "upstream" and "downstream" refer to the direction of light propagation.

BRIEF DESCRIPTION OF THE DRAWINGS

Other features and advantages of the invention will become apparent upon reading the following detailed description of non-limiting examples, for the understanding of which reference should be made to the appended drawings, in which:

FIG. 1 shows a plan view of the optical component according to one exemplary embodiment of the invention;

FIG. 2 shows a perspective view of FIG. 1, seen from above;

FIG. 3 shows a rear view of FIG. 1;

FIG. 4 shows a perspective view of FIG. 1, seen from below;

FIG. 5 shows a sectional perspective view along the plane AA' in FIG. 1;

FIG. 6 shows the cross section corresponding to the cross section of FIG. 5;

FIG. 7 shows a beam obtained with an optical component similar to that of FIG. 1 but with a planar first reflection surface; and FIG. 8 shows a beam obtained with the optical component illustrated in FIG. 1.

DETAILED DESCRIPTION

FIGS. 1 to 5 illustrate one exemplary embodiment of an optical component 1 according to the invention.

In this example, the axes X, Y, Z correspond to the longitudinal, transverse and vertical directions, respectively, of a vehicle in which the optical component 1 is intended to be installed. In these FIGS. 1 to 6, the optical component 1 is therefore oriented with respect to these axes X, Y, Z with the orientation that it is intended to have in this vehicle.

In this example, the optical component 1 is intended to perform a side lighting function. In this case, as illustrated in FIGS. 1 to 3, the front and the rear of the optical component 1 are therefore generally diagonal with respect to the longitudinal axis X and the transverse axis Y, the optical axis O of the optical component being oriented in this case in a direction close to a bisector formed between the longitudinal axis X and the transverse axis Y. In other words, once this has been installed in the vehicle in accordance with these orientations, the optical component 1 allows the lighting device comprising it to illuminate to the sides and diagonally, in this case between the left and the front of the vehicle.

In general, as illustrated in this example, in particular in FIG. 1, this optical component 1 may comprise a plurality of light guide portions 10. These guide portions 10 together form the optical component 1 in an integral manner. These guide portions 10 may in particular be integrally formed in one piece with the whole of the optical component 1.

According to the invention, as in this case, the guide portions 10 may be arranged side by side, in particular, as in this case, in a fan shape. This makes it possible to widen the overall lighting beam formed by the optical component 1 when it is coupled to light sources.

These guide portions 10 may, as in this case, be connected to one another by a portion of the optical component, called joining portion 30, forming the material continuity between two adjacent guide portions 10.

In this patent application, to explain the arrangement of these guide portions 10, the cuttings and cross sections in FIGS. 5 and 6 are taken at one of these guide portions 10, specifically the fourth guide portion starting from the right of the optical component 1 (specifically, in FIG. 1, the fourth from the bottom). Likewise, the references in the drawings are essentially placed on this fourth guide portion 10.

The various explanations and illustrations of the patent application may be transposed to each of the guide portions 10 of the optical component 1.

In this case, FIG. 6 schematically illustrates the path of the rays $r_1$, $r_2$ in the optical component 1, more precisely in this case in one of the guide portions 10, along with the various total internal reflection (or else TIR) surfaces 4, 5, 11, 21.

The optical component 1 is arranged so as to guide the rays $r_1$, $r_2$ between an entry diopter 2 for these rays and an exit diopter 9 of one and the same guide portion. This arrangement is preferably such that very few or even no rays pass through the joining portions 30.

The exit diopter 9 extends between a first reflection surface 11 and a second reflection surface 21. As in this case, these two reflection surfaces 11, 21 may extend essentially horizontally, the exit diopter 9 extending from bottom to top.

The first reflection surface 11 and the second reflection surface 21 in this case form the front portion of an upper portion of the guide portion 10. This front portion extends between the exit diopter 9 and another total internal reflection surface, specifically the return surface 4.

In this case, as may be seen in FIGS. 3 to 5, each guide portion 10 comprises a lower portion, extending downward between the entry diopter 2 and the return surface 4. In this example, this lower portion forms an entry collimator 3.

In general, as in this case, the optical component 1 may comprise, on each side, fastening means for fastening to a vehicle lighting device. In this case, the optical component 1 comprises two of these. These are in this case two fastening lugs 32, 33, formed integrally with the rest of the optical component 1.

As may be seen more particularly in FIG. 1, the optical component 1 comprises portions forming rear tabs 31 enabling the vertical positioning of the optical component 1, specifically in the Z direction.

Also, as in this case, referencing pins 34, 35, in particular of different shapes, may be provided so as to ensure a more precise position of the optical component 1 in the lighting device.

As may be seen in FIG. 5, at each guide portion 10, the lower surface comprises a cutoff edge 6, formed by a ridge separating the first reflection surface 11 from another total internal reflection surface 5, which forms a folder 5. The first reflection surface 11 extends downstream of the cutoff edge 6, from the cutoff edge 6 and toward, in this case up to, the exit diopter 9. The folder 5 extends upstream of the cutoff edge 6, from the cutoff edge 6 and toward, in this case up to, the collimator 3.

The second reflection surface 21 may be connected to the return surface 4 by other surfaces.

In general and as in this case, all of the upper portions of the guide portions 10 may form a plate 8, in this case with the joining portions 30. In FIGS. 1 and 2, it is essentially this plate 8 that is visible. This plate 8 is in particular thin with regard to the width of the optical component 1.

As for example illustrated in FIG. 5, the length L of the first reflection surface 11 from the cutoff edge 6 to the exit diopter 9 is greater than four times the height h of the exit diopter 9. For example, the height h of the exit diopter 9 may, as in this case, be less than 6 millimeters (mm).

In the example illustrated, each upper portion that is present is formed by the first reflection surface 11 and the folder 5. The length of the first reflection surface 11 of the guide portions 10 is in this case approximately 25 mm.

FIG. 6 is a longitudinal cross section, specifically along the maximum dimension along which the illustrated guide portion 10 under consideration extends. This figure makes it possible to illustrate the operation of each guide portion 10.

Once the optical component 1 has been positioned in the lighting device, in this case a headlight P, a light source is arranged opposite the entry diopter 2, formed at the bottom of the collimator 3.

In general, the entry diopter 2 is arranged so as to receive almost all, or even all, of the rays emitted by the light source 40. The collimator 3 focuses these rays $r_1$, $r_2$ toward the return surface 4. By virtue of its arrangement with the entry diopter 2, this return surface 4 returns the light rays $r_1$, $r_2$ from the entry diopter 2 to the cutoff edge 6.

In general, the exit diopter 9 may, as in this case, form a projection member, arranged so as to image the cutoff edge 6.

For example, as in this case, the exit diopter 9 may have a curvature arranged such that this exit diopter 9 forms a converging system having a row of focal points. This row of focal points is arranged so as to be superimposed on the cutoff edge 6.

It is possible to define multiple categories of rays returned by the return surface 4: the first rays $r_1$, the second rays $r_2$ and the third rays (not shown).

The path of the first rays $r_1$ will be described in more detail further below.

In general, as in this case, each guide portion 10 may be arranged such that the rays passing at the cutoff edge 6 directly reach the exit diopter 9. These are said second rays. Since this cutoff edge 6 is superimposed on the row of focal points, these second rays $r_2$ then exit parallel to the direction of the optical axis of the corresponding guide portion 10, which axis is oriented horizontally according to this illustrated example.

In general, as in this example, the third rays, not shown, may impinge on the folder 5 slightly upstream of the cutoff edge 6. The folder 5 is oriented such that it returns these third rays to the second reflection surface 21, which, by virtue of its arrangement, returns them to the exit diopter 9. These third rays will thus pass above the cutoff edge 6 and therefore the row of focal points, such that the exit diopter 9 refracts them downward.

The second rays $r_2$ form the upper limit of the beam, the third rays being directed below this limit. As a result, the exit diopter 9, from these rays, projects a beam having a cutoff line formed by this upper limit, which corresponds to the shape of the cutoff edge 6.

However, in the case of an elongate and thin upper portion, as in this example, in particular in the case of a plate 8, the angle between the folder 5 and the first reflection surface 11 seen from the inside of the corresponding guide portion 10 is not very pronounced, in particular between 180° and 225°. There is a risk that some rays, specifically said first rays, passing directly above the cutoff edge 6 after they have been deflected by the return surface 4, will reach the first reflection surface 11, rather than directly reach the exit diopter 9. In such a case, there is a risk that these first rays $r_1$ will be reflected upward by the first reflection surface 11 and then reach the exit diopter 9. These first rays would thus come virtually from below the row of focal points and would therefore be refracted upward, creating a risk of dazzling.

To avoid this, the first reflection surface 11 comprises an arrangement from the cutoff edge 6, here in the form of prisms 13, making it possible to prevent the first rays $r_1$, passing next to, in this case above, the cutoff edge 6, from traveling, after total internal reflection from the first reflection surface 11, directly to the exit diopter 9.

In this case, these prisms 13, called first prisms 13, are formed by an alternation of ribs and crests that are oriented generally perpendicular to the optical axis of the corresponding guide portion 10. Each first prism 13 thus comprises a slope or reflection facet 14 that is oriented upstream and a joining facet 15 that is oriented downstream.

It is these reflection facets 14 that are arranged so as to allow the first reflection surface 11 to deflect the first rays $r_1$ through total internal reflection from these reflection facets 14. Through this deflection, the reflection facets 14 send these first rays $r_1$ from the second reflection surface 21 at an angle that makes it possible to produce total internal reflection from this said second reflection surface 21. These first rays $r_1$ are then reflected toward the exit diopter 9 after this reflection from this said second reflection surface 21. This reflection is thus called terminal total internal reflection.

The slopes of the reflection facets 14 are increasingly less steep as they move away from the cutoff edge 6 toward the exit diopter 9. The first rays $r_1$ in fact have an increasingly grazing nature the further away their point of impact on the first reflection surface 11 is from the cutoff edge 6.

In this case, the first prisms 13 are arranged up to the exit diopter 9. However, it is possible to arrange them only on an upstream portion of the first reflection surface 11, for example over the first 12 to 15 millimeters and/or at least over the first third of the first reflection surface 11.

The pitch between the first prisms 13 is constant in this case. This simplifies the design of the optical component 1 and potentially avoids variations in thickness of the component. As in this example, the pitch between the first prisms may be approximately 1 mm.

In this case, the second reflection surface 21 is smooth. However, as an alternative, it could also comprise a plurality of prisms, called second prisms, the reflection facets of which would be arranged so as to reflect the first rays $r_1$ reflected by the first reflection surface 11 toward the exit diopter 9.

These second prisms may have the same features as the first prisms 13, in particular with regard to their pitch and/or the slope of their reflection facets 14.

Each of the guide portions 10 is thus able to form a beam having an upper cutoff. The sum of all of these beams forms the overall side lighting beam F, illustrated in FIG. 8. It may be observed that this overall beam F has a cutoff line C arranged on the horizon H. Above the cutoff line C, the isolux curves that are illustrated represent rays that are parasitic but that are in a quantity low enough not to cause dazzling.

In the absence of the first prisms 13, the beam F' of FIG. 7 is obtained. Although said beam also has a horizontal cutoff line C', there are however more parasitic rays above the cutoff line C'. The risk of dazzling is higher.

Moreover, these first prisms 13 make it possible to reinject certain rays, specifically the first rays $r_1$, under the cutoff line C and thus give a vertical thickness of the beam F that is greater than that of the beam F' obtained without the first prisms 13.

The efficiency and the quality of the corner lighting beam has therefore been improved in spite of the small thickness of the guide portions 10 and therefore of the plate 8 of the optical component 1.

Although it is particularly beneficial in the context of corner lighting, the invention may be applied to other types of beam with a cutoff, such as a fog beam, or even a low beam.

The invention claimed is:

1. An optical component intended to operate with total internal reflection and comprising at least one light guide portion, the guide portion comprising:

an entry diopter, a reflecting surface, a cutoff edge, a first total internal reflection surface downstream of the cutoff edge, a second total internal reflection surface, an exit diopter that includes a row of focal points, the row of focal points being arranged on the cutoff edge, the entry diopter and the reflecting surface being arranged such that the reflecting surface reflects light rays from the entry diopter toward the row of focal points, the optical component being characterized in that these light rays include first rays that pass next to the cutoff edge and reach the first reflection surface, the first reflection surface being arranged so as to reflect these first rays toward the second reflection surface so as to produce a terminal total internal reflection from the second reflection surface, these first rays being reflected toward the exit diopter through this terminal total internal reflection.

2. The optical component as claimed in claim 1, wherein the first reflection surface includes at least one facet arranged so as to reflect the first rays toward the second reflection surface so as to produce the terminal total internal reflection.

3. The optical component as claimed in claim 2, wherein the first reflection surface includes one or more prisms, with the one or more prisms each having a reflection slope from which the corresponding first rays are reflected, with each facet being formed by the reflection slope.

4. The optical component as claimed in claim 3, wherein, when the first reflection surface has multiple prisms, the reflection slopes are increasingly less steep as they move away from the cutoff edge toward the exit diopter.

5. The optical component as claimed in claim 3, wherein, when the first reflection surface has multiple prisms, the pitch between the first prisms is constant.

6. The optical component as claimed in claim 3, wherein, when the first reflection surface has multiple prisms, the pitch between the prisms is approximately 1 mm.

7. The optical component as claimed in claim 1, wherein the second reflection surface comprises at least one facet arranged so as to reflect some of these rays reflected by the first reflection surface toward the exit diopter.

8. The optical component as claimed in claim 1, wherein a length of the first reflection surface from the cutoff line to the exit diopter is greater than twice a height of the exit diopter.

9. The optical component as claimed in claim 1, comprising a plurality of the guide portions.

10. The optical component as claimed in claim 9, comprising a plate including a downstream segment of which bears the exit diopters of the guide portions, the plate comprising the guide portions arranged directly or indirectly adjacently.

11. A vehicle lighting device, comprising:

an optical component including at least one light guide portion, the guide portion including, an entry diopter, a reflecting surface, a cutoff edge, a first total internal reflection surface downstream of the cutoff edge, a second total internal reflection surface, an exit diopter that includes a row of focal points, the row of focal points being arranged on the cutoff edge, the entry diopter and the reflecting surface being arranged such that the reflecting surface reflects light rays from the entry diopter toward the row of focal points, the optical component being characterized in that these light rays include first rays that pass next to the cutoff edge and reach the first reflection surface, the first reflection surface being arranged so as to reflect these first rays toward the second reflection surface so as to produce a terminal total internal reflection from this the second reflection surface, these first rays being reflected toward the exit diopter through this terminal total internal reflection, and a light source facing the entry diopter, with the vehicle lighting device being arranged such that the rays emitted by the light source exit the exit diopter so as to contribute to producing a lighting beam with a cutoff, with the cutoff being a flat cutoff.

* * * * *